US006464114B2

(12) United States Patent
Goeltenboth et al.

(10) Patent No.: US 6,464,114 B2
(45) Date of Patent: Oct. 15, 2002

(54) RESERVOIR FOR DRINKS DISPENSING MACHINES

(75) Inventors: Frank Goeltenboth, Blaustein; Alexander Kiefer, Kuchen, both of (DE)

(73) Assignee: WMF Wuerttembergische Metallwarenfabrik AG, Geislingen/Steige (DE)

( * ) Notice: Subject to any disclaimer, the term of this patent is extended or adjusted under 35 U.S.C. 154(b) by 0 days.

(21) Appl. No.: 09/891,769

(22) Filed: Jun. 26, 2001

(65) Prior Publication Data

US 2002/0014500 A1 Feb. 7, 2002

(30) Foreign Application Priority Data

Jun. 27, 2000 (EP) ..... 00 113 596

(51) Int. Cl.[7] ..... B67D 3/00
(52) U.S. Cl. ..... 222/481.5; 222/527
(58) Field of Search ..... 222/481.5, 527, 222/566

(56) References Cited

U.S. PATENT DOCUMENTS

| | | | | | |
|---|---|---|---|---|---|
| 4,134,697 | A | * | 1/1979 | Sparr, Sr. | 222/481.5 |
| 4,522,319 | A | * | 6/1985 | Richter | 222/481.5 |
| 4,964,532 | A | * | 10/1990 | Kirschner et al. | 222/481.5 |
| 4,993,604 | A | * | 2/1991 | Gaunt et al. | 222/481.5 |
| 5,855,162 | A | | 1/1999 | Bauer et al. | 99/290 |

FOREIGN PATENT DOCUMENTS

| | | |
|---|---|---|
| EP | 0 129436 | 12/1984 |
| EP | 0 203744 | 12/1986 |
| EP | 0 820715 | 12/1998 |
| GB | 2033333 | 5/1980 |

* cited by examiner

*Primary Examiner*—Joseph A. Kaufman
(74) *Attorney, Agent, or Firm*—Marshall, Gerstein & Borun

(57) ABSTRACT

A reservoir for drinks dispensing machines having a reservoir body, an output line for outputting liquids in predetermined quantities, and a level compensation ability. The reservoir body above the liquid level is closed in a substantially air-tight manner, and a ventilation opening is arranged below the liquid level to achieve level compensation of the liquid level in the reservoir body.

10 Claims, 2 Drawing Sheets

RESERVOIR FOR DRINKS DISPENSING MACHINES

FIELD OF THE INVENTION

This invention relates to a reservoir for drinks dispensing machines.

BACKGROUND OF THE INVENTION

Many drinks dispensing machines available in the market, such as automatic coffee or tea making machines, contain reservoirs for various liquids and drinks, e.g. integrated milk containers heat storing containers for ready-to-dispense drinks, or water containers for preparing drinks, from which liquid quantities which have a constant predetermined volume are to be tapped, either to fill a predetermined portion container, such as a cup or a pot, with a drink, or to take off a predetermined amount of water for preparing a predetermined amount of drink, or to take off a predetermined amount of milk for mixing it with a predetermined amount of coffee or tea or for foaming up for the preparation of cappuccino. In all these cases it is necessary that the predetermined volume of liquid is substantially constant during each tapping process, no matter how high the liquid level is in the reservoir. A high liquid level in the reservoir for instance during discharge by gravity or by a time-controlled valve will lead to a slightly increased discharge quantity compared to the discharge quantity which exits at the same valve opening time but at a lower filling level in the reservoir. At present, this is managed in that either a constant overpressure is generated in the reservoir above the liquid level or in that the filling level in the reservoir is detected by probes and the time control is varied accordingly. Both measures are relatively complicated.

SUMMARY OF THE INVENTION

The object of the invention is to provide a reservoir by means of which a level compensation can be obtained in a simple constructive way.

By the substantially air-tight closure of the reservoir body, an increasing vacuum will build up above the liquid level when liquid is taken from the container body, said vacuum counteracting the weight of the liquid column in the reservoir body. There will be a balance between the external pressure applying at the ventilation opening and the vacuum in the container body above the liquid level, wherein air drops in from the ventilation opening as soon as the vacuum in the reservoir body drops by a predetermined value below the external pressure. This balance does not depend on the height of the liquid column in the reservoir body, so that an appropriate compensation of the weight of the liquid column is achieved at any height of the liquid column in the reservoir body.

In stationary reservoirs, i.e., reservoirs that cannot be tilted for being filled, the measure according to the invention is sensible.

There are different preferred arrangements of the ventilation opening.

It is ensured that the air bubbles dropping in do not become too large.

There is ensured a complete emptyability of the reservoir.

The embodiments of the output line are the simplest possibility in terms of construction, since a further passage to the reservoir to be sealed is not required.

The present invention facilitates filling the reservoir body.

BRIEF DESCRIPTION OF THE DRAWINGS

Embodiments of the invention will now be described in detail by means of the drawings.

DETAILED DESCRIPTION OF THE INVENTION

Figure 1:
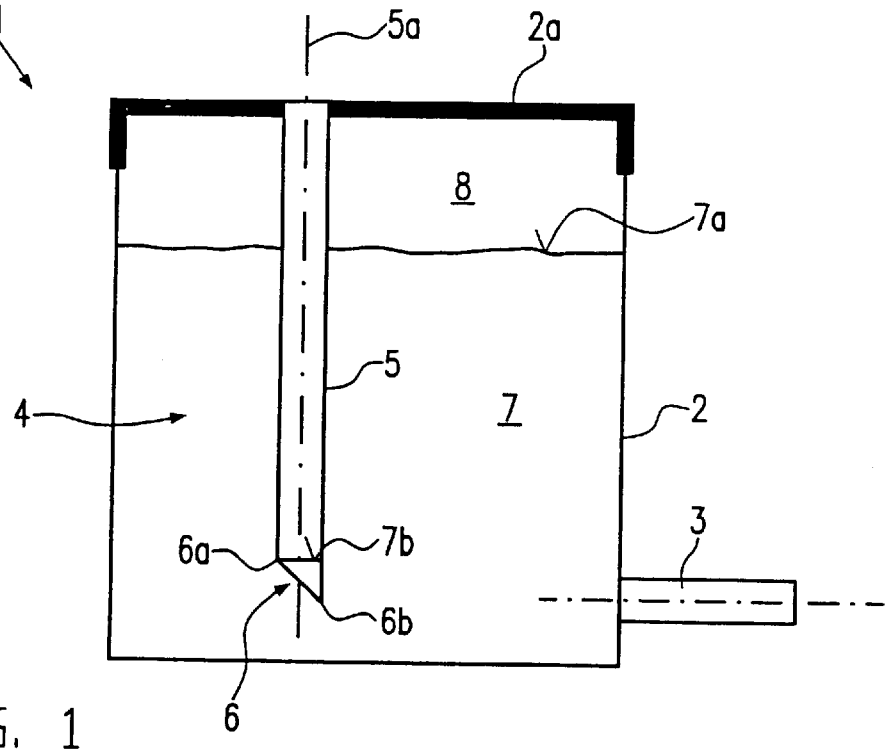
FIG. 1 shows a first embodiment of a reservoir according to the invention in a diagrammatic sectional view.

FIG. 1 shows a first embodiment of a reservoir according to the invention, as it can for instance be used in an automatic coffee making and dispensing machine for temporarily storing coffee or other drinks, such as milk, or a predetermined quantity of hot water. The reservoir 1 is used in places where a liquid is to be output in amounts of predetermined volume, wherein the predetermined volume amount shall remain constant, no matter how high the liquid level still is in the reservoir 1. This may for instance become necessary during the course of a preparation cycle for a drink, or it may become necessary when a user pressing a button intends to take always the same volume quantity of a drink, e.g. for exactly filling cups or a portion vessel.

The reservoir 1 contains the actual reservoir body 2 and a lid 2*a,* which is in a substantially air-tight manner seated on the reservoir body 2. "In a substantially air-tight manner" does not necessarily have to mean an absolute tightness. It is sufficient if the seat of the lid is capable of maintaining a vacuum at least over the normal operating time of a drinks machine, e.g. 8 hours, with no considerable fluctuations affecting the function.

At its lowermost end, the reservoir body 2 is connected to an output line 3, said output line leading to an output device, which is not shown, having or not having a time-controlled valve.

The reservoir 1 contains a means 4 for level compensation, which comprises a ventilation channel 5 in the form of a tube having a perpendicular center line 5*a,* said tube being attached to the lid 2*a* and extending downwards into the reservoir body 2 up to the proximity of the bottom. The tube 5 is open through the lid 2*a* and communicates with the outer side of the reservoir 1, preferably with the atmosphere. If pressure fluctuations of the atmospheric pressure cause trouble, the tube 5 may also be connected to a compensation pressure vessel. The tube 5 extends with a perpendicular center line 5*a* up to the proximity of the bottom of the reservoir body 2 and is open there for forming a ventilation opening 6. The ventilation opening 6 extends preferably obliquely to the center line 5*a* and includes an upper edge portion 6*a* that may be corrugated, jagged, punched etc. to prevent the formation of large air bubbles.

In this connection it must be mentioned that "upward" and "downward" means the direction in the drawings that defines the direction of gravity.

The reservoir 1 is either filled with liquid 7 when the lid 2*a* is removed or via a filling means, that is not shown, up to the maximum filling level in the reservoir body 2, wherein the liquid level in the reservoir body 2 and in the tube 5 are initially on the same level. If liquid is then sucked off via the output line 3 or if it is discharged by gravity, the level 7*a* of the liquid 7 in the reservoir body 2 sinks, so that on top a free space 8 with vacuum is formed. This vacuum counteracts the weight of the liquid column in the reservoir body 2 so that it no longer affects the quantity taken off through the output line 3. In the course of an increase of vacuum in the chamber 8, depending on the differences in the cross sectional surface of the tube 5 and of the reservoir body 2, the liquid level 7*b* in the tube drops to a greater extent than the liquid level 7*a* in the reservoir body 2 and reaches the upper edge 6*a* of the ventilation opening 6. This causes air to be pressed in. This air bubbles upwards and increases the pressure in the chamber 8 so that the liquid level 7*b* rises above the upper edge 6*a* and the ventilation is stopped.

The embodiment according to FIG. 1 is especially suitable for applications in which the liquid, possibly after a short sucking-on operation, flows out by means of gravity. The cross-sectional surface of the output line 3 shall approximately correspond to the cross-sectional surface of the tube 5, and the upper edge 6*a* of the opening 6 shall be located above the upper edge of the output line 3.

Figure 2:
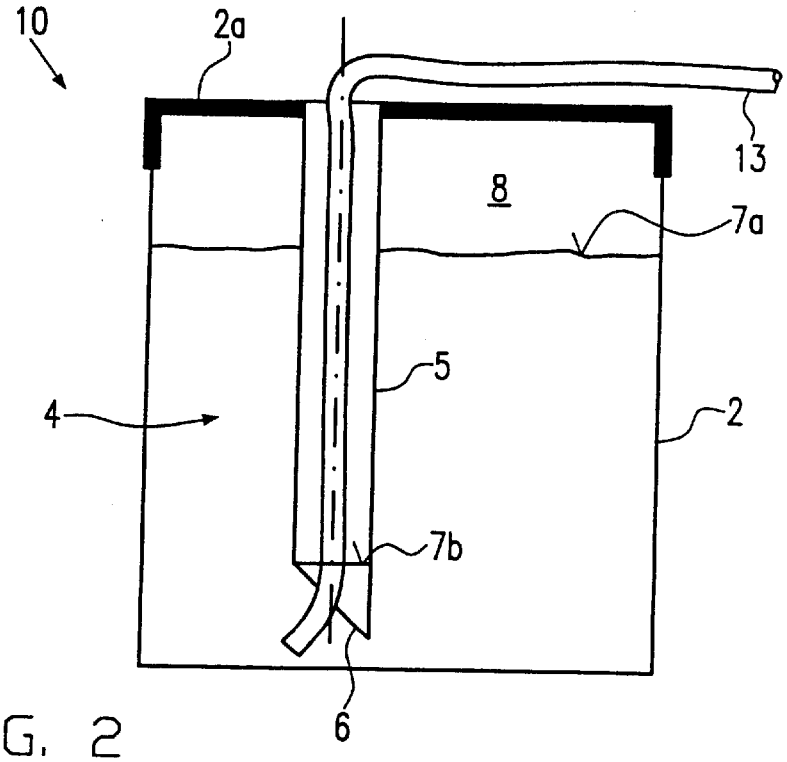
FIG. 2 shows a second embodiment of a reservoir according to the invention in a diagrammatic sectional view.

FIG. 2 shows a modified embodiment 10 of the reservoir of FIG. 1, wherein equal or comparable components are characterized by the same reference numerals and are not explained again. The reservoir 10 differs from the reservoir 1 only by the fact that instead of the fixed output line 3 extending through the wall in the lower portion of the reservoir 2, a hose 13 is provided which was pushed through the ventilation channel 5 and the ventilation opening 6 and which rests on the bottom of the reservoir body 2. The cross-sectional surface of the hose 13 and the tube 5 can be larger than shown in the Figure, wherein a small gap only must remain between the ventilation tube 5 and the hose 13. The liquid is sucked-off, otherwise the function of this reservoir 10 corresponds to the function of the reservoir 1.

Figure 3:
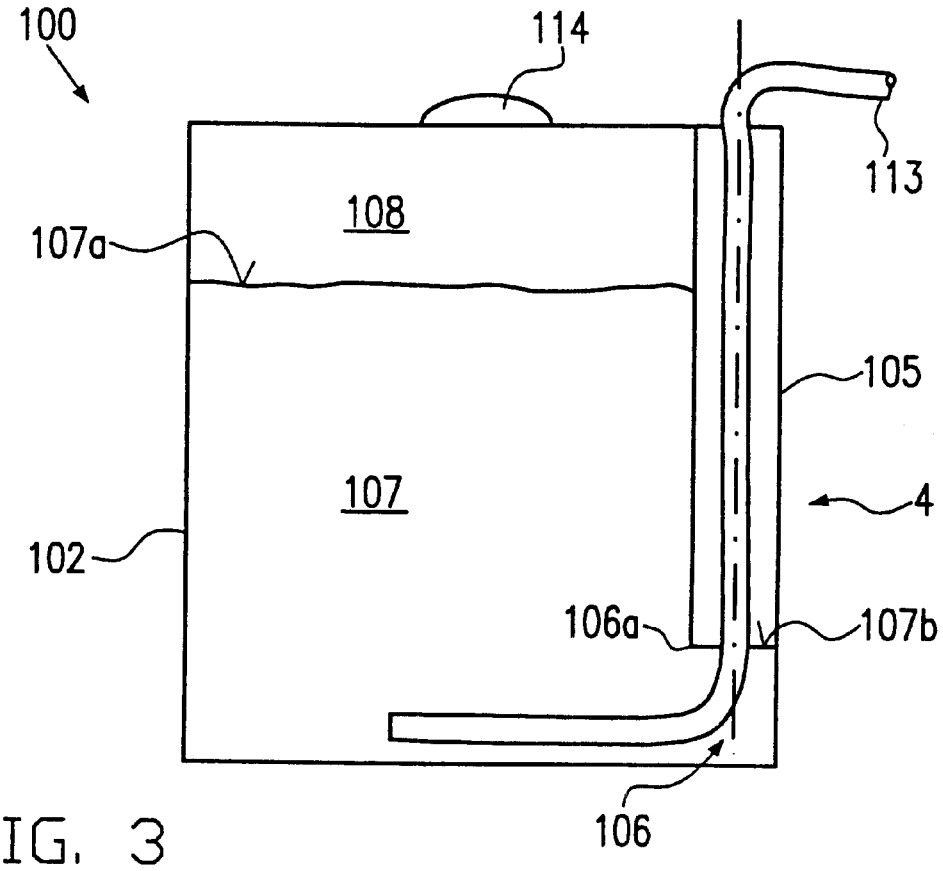
FIG. 3 shows a third embodiment of a reservoir according to the invention in a diagrammatic sectional view.

FIG. 3 shows another embodiment of a reservoir 100 according to the invention in a slightly modified form. The reservoir 100 includes a reservoir body 102, which can be formed closed or which can be provided with a lid. The means 4 for level compensation includes a ventilation opening 106, which extends through the wall of the reservoir body 102 in the proximity of the bottom, preferably in a manner connected to the bottom, and which is arranged with an upper edge 106*a* above the bottom. Outside the reservoir body 102, a ventilation channel 105 is connected to the ventilation opening 106, said ventilation channel leading from the ventilation opening 106 upwards up to the proximity of the lid or the upper lid wall of the reservoir body 102 and which is open there. The output line in turn is formed as a hose 113, extending through the ventilation channel 105 and the ventilation opening 106 and ending in the proximity of the bottom of the reservoir body.

The reservoir body 100 acts as the already above-described reservoir 1 and 10, that means when sucking off liquid 107 through the output line 113, a vacuum builds up in the space above the liquid level 107*a* in the reservoir body 102, and a further liquid level 107*b* builds up in the ventilation channel 105 on which the atmospheric pressure or a pressure from a pressure compensation vessel acts. The upper edge 106*a* of the ventilation opening 106 is also formed in a way that larger air bubbles are not formed, i.e. the upper edge 106 is corrugated, jagged or punched.

If the reservoir 100 is formed closed, i.e. is not provided with a lid, a return valve 114 is preferably provided at the position being uppermost during operation through which the air displaced when filling the reservoir 100 can escape via the ventilation channel 105.

An especially preferred embodiment of the reservoir according to the invention is its use as a reservoir for milk in a coffee machine having an integrated milk foaming-up system, as for instance described in EP 820 715. This milk foaming-up devices make use of the Venturi effect of a vapor shock to entrain milk from a reservoir and to foam it up. This Venturi effect is sufficient to draw off the required and predetermined amount of milk from the reservoir according to the invention. The reservoir may, as common in drinks dispensing machines, either be cooled or heated and insulated.

In a modification of the described and characterized embodiments, details drawn by means of the individual Figures can be mutually replaced. Thus, the reservoir according to FIG. 3 may also be provided with a fixed output line or a bevelled ventilation opening. The ventilation channel does not necessarily have to extend straightly upward but may also define an arc etc. The ventilation channel may have any desired cross-sectional shape and its cross-sectional size may purposefully be adapted to the cross-sectional size of the reservoir body and/or the output line so that at a predetermined suction or output pressure a regular flow is ensured. When the bottom has a different shape or if a complete emptying is ensured in another manner, or if this emptying is not necessary, the outlet opening and the ventilation opening do not have to be arranged in the proximity of the bottom. Furthermore, the outlet opening does not necessarily have to be arranged below the ventilation opening if a sufficient suction pressure and a complete emptying is ensured.

We claim:

1. A reservoir (1, 10, 100) for drinks dispensing machines, comprising in combination a reservoir body (2, 102), an output line (3, 13, 113) for outputting a liquid at predetermined quantities, and means (4) for level compensation of the liquid level (7*a,* 107*a*) in said reservoir body (2, 102), said reservoir body (2, 102) above the liquid level (7, 107*a*) being substantially closed in an air-tight manner, said means (4) for level compensation comprises a ventilation opening (6, 106) arranged below the liquid level (7*a,* 107*a*), and said output line (13, 113) extends through said ventilation opening (6, 106).

2. A reservoir as claimed in claim 1, wherein said ventilation opening (6, 106) is connected to a ventilation channel (5, 105), which above the liquid level (7*a,* 107*a*) communicates with the atmosphere.

3. A reservoir as claimed in claim 1, wherein said ventilation opening (6) is provided at the lower end of a ventilation channel (5) extending from the top into said reservoir body (2).

4. A reservoir as claimed in claim 1, wherein said ventilation opening (106) is provided in a side wall of said reservoir body (102) and is connected to an upwardly leading ventilation channel (105).

5. A reservoir as claimed in claim 1, wherein said ventilation opening (106) extends obliquely with respect to the vertical.

6. A reservoir as claimed in claim 1, and wherein an upper limitation edge (6*a,* 106*a*) of said ventilation opening (6, 106) is formed in a manner for avoiding larger air bubbles.

7. A reservoir as claimed in claim 6, wherein said upper limitation edge is formed as corrugated, jagged, or in a punched manner.

8. A reservoir as claimed in claim 1, wherein said output line (3, 13, 113) is arranged below said ventilation opening (6, 106).

9. A reservoir as claimed in claim 1, wherein said output line (13, 113) is formed as a hose.

10. A reservoir as claimed in claim 1, wherein said reservoir body (2, 102) is closed by a lid (2*a*) in a substantially air-tight manner.

* * * * *